US011619461B2

(12) United States Patent
Alvarez

(10) Patent No.: US 11,619,461 B2
(45) Date of Patent: Apr. 4, 2023

(54) CONTROL SYSTEM FOR ROTARY FIREARMS

(71) Applicant: Montana Marcus Alvarez, Desert Center, CA (US)

(72) Inventor: Montana Marcus Alvarez, Desert Center, CA (US)

( * ) Notice: Subject to any disclaimer, the term of this patent is extended or adjusted under 35 U.S.C. 154(b) by 0 days.

(21) Appl. No.: 17/480,565

(22) Filed: Sep. 21, 2021

(65) Prior Publication Data

US 2022/0003515 A1 Jan. 6, 2022

Related U.S. Application Data

(60) Provisional application No. 63/081,246, filed on Sep. 21, 2020.

(51) Int. Cl.
*F41A 19/67* (2006.01)
*F41A 19/68* (2006.01)

(52) U.S. Cl.
CPC ..... *F41A 19/67* (2013.01); *F41A 19/68* (2013.01)

(58) Field of Classification Search
CPC .... F41A 7/08; F41A 7/10; F41A 19/00; F41A 19/03; F41A 19/04; F41A 19/58; F41A 19/59; F41A 19/64; F41A 19/65; F41A 19/66; F41A 19/67; F41A 19/68
USPC ..... 89/1.41, 12
See application file for complete search history.

(56) References Cited

U.S. PATENT DOCUMENTS

| | | | | |
|---|---|---|---|---|
| 3,263,565 | A * | 8/1966 | Dragonetti | F41F 1/10 89/1.804 |
| 9,464,856 | B2 * | 10/2016 | Lung | F41A 27/08 |
| 10,871,336 | B1 * | 12/2020 | Johnston | F41F 1/10 |
| 2016/0025435 | A1 * | 1/2016 | Lung | F41A 9/57 89/37.15 |
| 2016/0305740 | A1 * | 10/2016 | O'Donnell | F41F 1/10 |

* cited by examiner

*Primary Examiner* — John Cooper
(74) *Attorney, Agent, or Firm* — Barry Choobin; Patent 360

(57) ABSTRACT

A Gatling-style platform has a control system to limit the number of ammunitions that can be fired a single or multiple times. The control system is operably coupled to an electronic motor that can be coupled to multi-barrels for rotating the multi-barrels and a delinker to feed the ammunition. The electronic firearm further includes an electronic rotary trigger that has multiple discrete intervals that correspond to the number of ammunition or rounds of ammunition to be fired, wherein the electronic rotary trigger can be rotated to any desired level from the multiple discrete intervals, the rotation of the electronic rotary trigger actuates the delinker and/or motor to start firing.

11 Claims, 4 Drawing Sheets

CONTROL SYSTEM FOR ROTARY FIREARMS

CROSS-REFERENCE TO RELATED APPLICATIONS

This application claims priority from the U.S. provisional patent application Ser. No. 63/081,246, filed on Sep. 21, 2020, which is incorporated herein by reference in its entirety

FIELD OF INVENTION

The present invention relates to a firearm, and more particularly, the present invention relates to a control system for a Gatling gun or Gatling style of platform that can limit the number of ammunitions or rounds of ammunition fired and an electronic rotary trigger that can be rotated to fire.

BACKGROUND

Modern Gatling guns are electronic that can fire at a splendid rate of 3000 to 6000 bullets per min or even more. Most of the current research on Gatling guns is focused mainly on increasing this firing rate and decreasing the weight. The research is also underway on miniaturizing the Gatling guns. M134 manufactured by General Electric also referred to as a minigun, is smaller than its predecessor M61 Vulcan.

The high firing rate is a characteristic of Gatling-style platforms, however, limiting the number of ammunition or rounds of ammunition that can be fired in a single time or a limited number of times is also a desirable feature that is not available currently in any electronic gun. Controlling the ammunition being fired can save the ammunition. Additionally, it is also desired to control the rate of firing to save the ammunition. The known Gatling-style platforms or similar electronic guns suffer from the major drawbacks of lacking such control over firing. Thus, a desire is there for a control system for Gatling-style platforms to control the number of ammunitions fired.

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to a control system for Gatling-style platforms that can limit the number of ammunitions that can be fired.

It is another object of the present invention that the control system can save ammunition.

It is still another object of the present invention that the control system can make the firing experience better for firearm operators and enthusiasts.

It is a further object of the present invention that the control system can control the rate of firing.

It is a further object of the present invention that the control system can operate in fully automatic and semi-automatic modalities.

These and other objects and advantages of the embodiments herein and the summary will become readily apparent from the following detailed description taken in conjunction with the accompanying drawings.

BRIEF DESCRIPTION OF THE DRAWINGS

The accompanying figures, which are incorporated herein, form part of the specification and illustrate embodiments of the present invention. Together with the description, the figures further explain the principles of the present invention and enable a person skilled in the relevant arts to make and use the invention.

DETAILED DESCRIPTION

Figure 1:
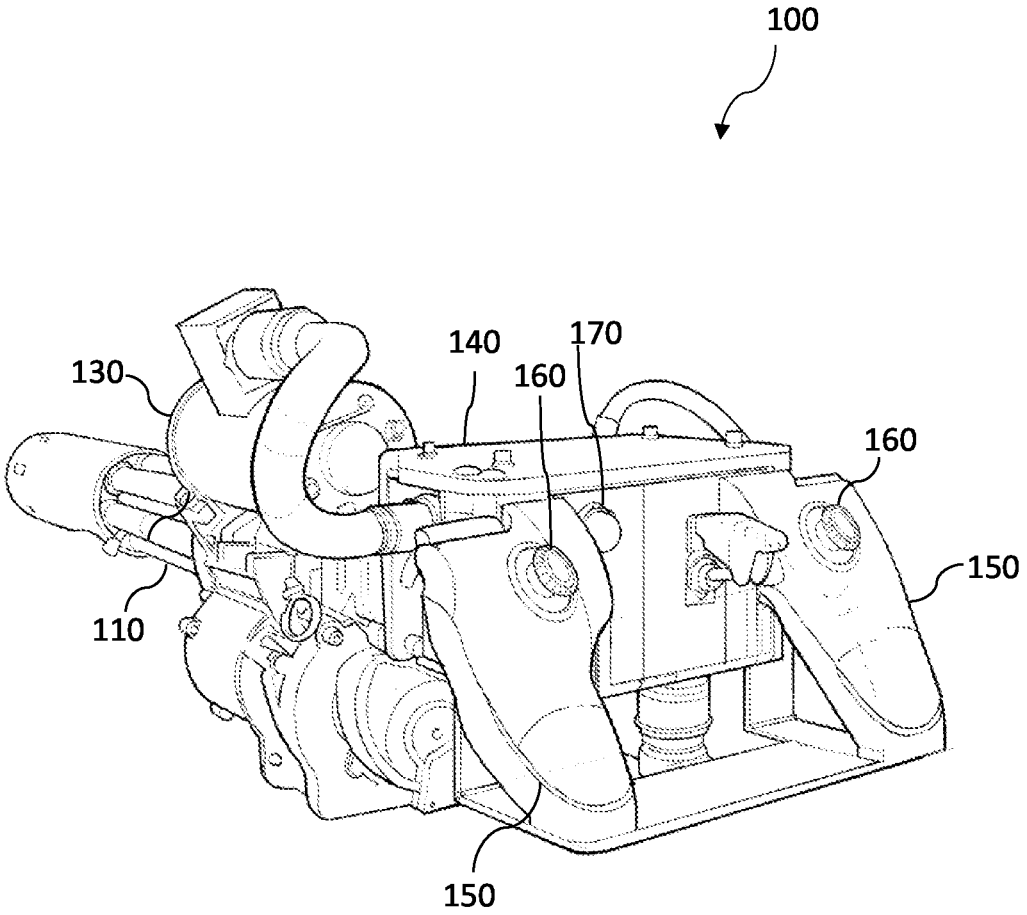
FIG. 1 is a perspective view of a Gatling-style platform with a control system, according to an exemplary embodiment of the present invention.
Figure 2:
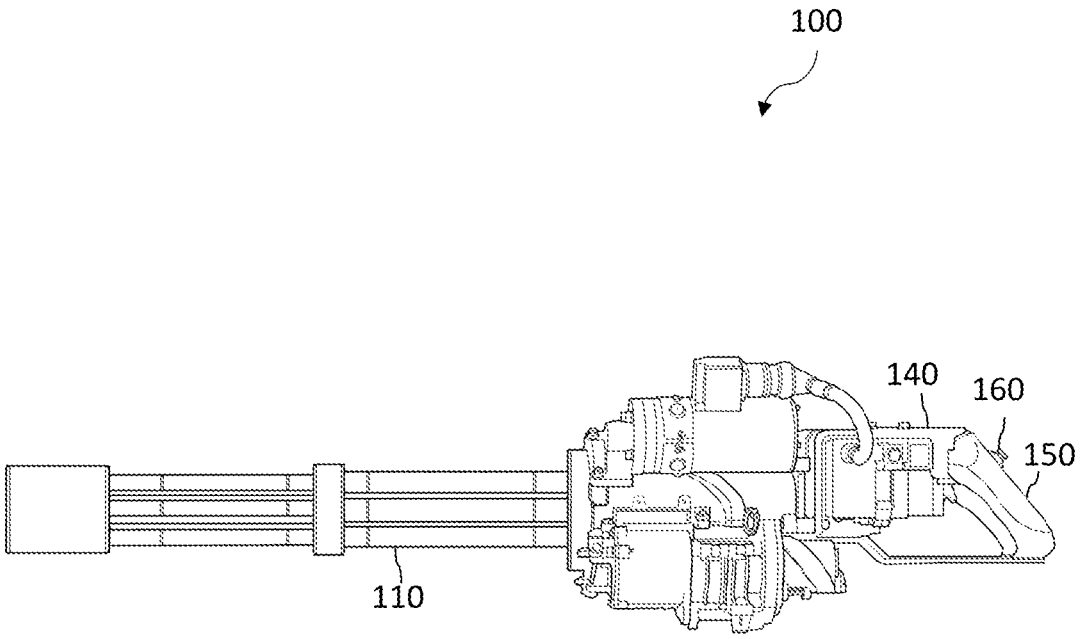
FIG. 2 is a side view of the Gatling-style platform with the control system, according to an exemplary embodiment of the present invention.

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary, or the following detailed description.

Disclosed is a control system for a Gatling-style platform that can limit the number of ammunitions fired. The control system can also control the rate of firing to predefined discrete levels. The disclosed control system can make the Gatling-style platforms versatile and save ammunition by limiting the ammunition that can be fired and optionally decreasing the firing rate. The shooter can have more time to focus on the target without wasting ammunition. Similarly, novice users may not get overwhelmed by the extreme firing rate of Gatling-style platforms or similar electronic guns. The electronic rotary trigger is an electronic component contained within the control system that operates rotationally, analogous but not limited to, an analog stick or a rotary switch. The disclosed control system can operate in fully automatic and semi-automatic modalities due to its rotational operation.

Figure 3:
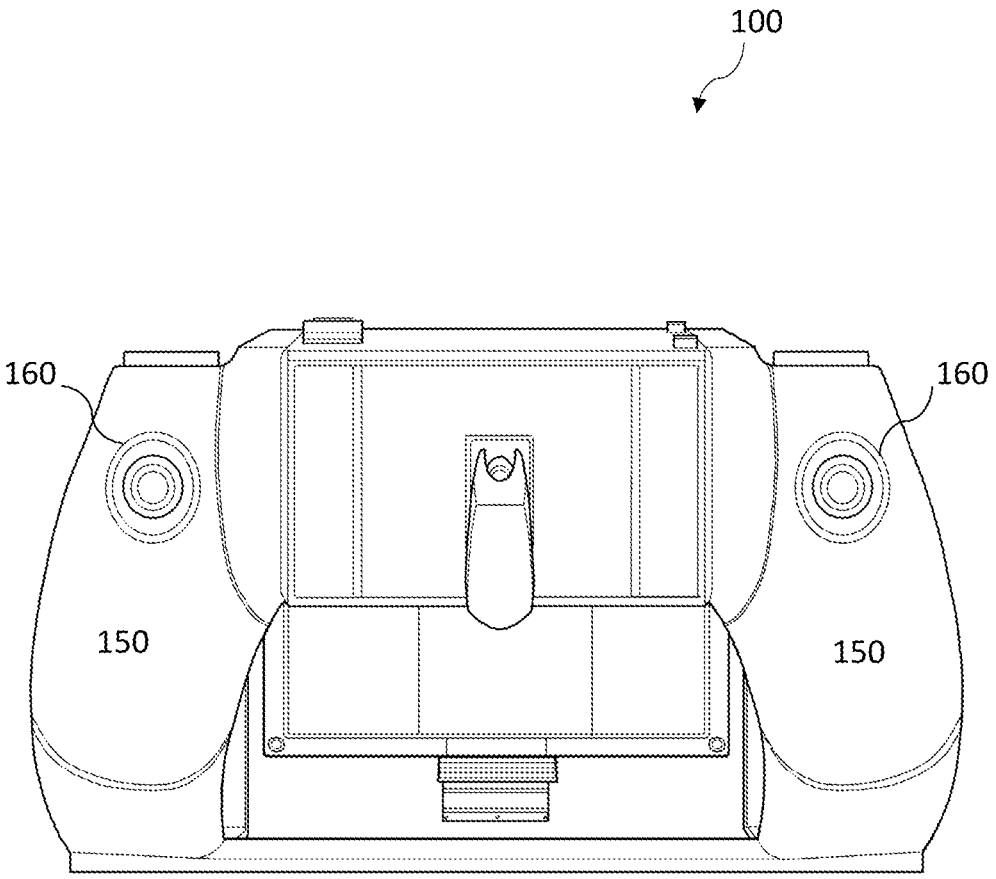
FIG. 3 is a rear view of the Gatling-style platform with the control system and showing the electronic rotary trigger, according to an exemplary embodiment of the present invention.
Figure 4:
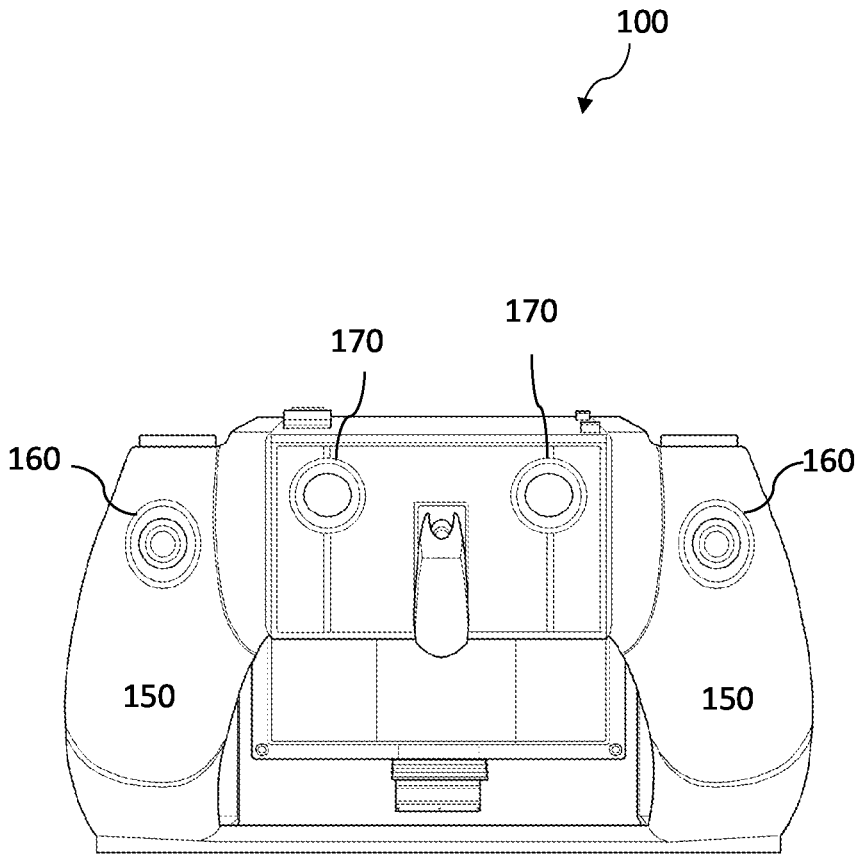
FIG. 4 is a rear view of the Gatling-style platform with the control system and showing the electronic rotary trigger and a push-button, according to an exemplary embodiment of the present invention.

Referring to FIGS. 1-4, which show a Gatling-style platform 100, having multi-barrels 110, and a motor 130 that rotates the multi-barrels. The motor is the engine behind the extreme firing rate achieved by the Gatling-style platforms. A control system 140 can control the operation of the motor within predefined levels for controlling the firing to predefined number of ammunitions and/or rate of firing. Two handles 150 can also be seen that can be used to maneuver the Gatling-style platform. Two electronic rotary triggers 160 can also be seen on the two handles 150 such as a user holding the two handles can actuate the electronic rotary triggers by rotational action. Two push-buttons 170 can also be seen on the two handles 150 such as a user holding the two-handle can actuate the push-buttons with depressing actions. It is to be understood that the drawings illustrate a preferred position for the electronic rotary triggers, however, the electronic rotary triggers can be provided at any other suitable location without departing from the scope of the present invention. Also, the rotary mechanism and the trigger mechanism can be provided separately without departing from the scope of the present invention. In one case, rotating the electronic rotary trigger can actuate both the motor and the delinker of the Gatling-style platform as shown in FIG. 3. In one case, rotating the electronic rotary trigger can actuate the motor and a separated push-button can be provided for the delinker as shown in FIG. 4. In one case, rotating the electronic rotary trigger and separated push-button can actuate both the motor and delinker of the Gatling-style platform as shown in FIG. 4. In one case, the rotation of the electronic rotary trigger can be similar to the cranking of a Gatling gun and can result in firing without actuating any other trigger or push-button. A clutch can also be provided for connecting the control system to the delinker of the Gatling-style platform. The working and functioning of the delinker to feed ammunition are known to a skilled person for use in Gatling-style platforms.

In one exemplary embodiment, multiple discrete levels corresponding to different numbers or ranges of ammunition or rounds of ammunition to be fired can be marked around the electronic rotary dial. The electronic rotary dial can have a pointer that can be pointed to the desired level in the multiple discrete levels. Thereafter, the user can press the trigger to actuate the firing sequence. In one case, an option can also be provided that allows a user to specify that the preset level correspond to firing the selected rounds of ammunition in a single time or can be fired in multiple trigger actuation. For example, the user can select a predefined level for multiple trigger actuation, the user can depress the push-button or rotate the electronic rotary trigger in intervals to fire till the selected quota of ammunition (level) is exhausted. Once, exhausted, the electronic rotary dial can be reset for selecting a level again or bypassing the control system.

In a preferred embodiment, the electronic rotary trigger can be divided into discrete intervals, wherein each interval can correspond to a number of ammunitions that can be fired. The user can manually rotate the electronic rotary trigger by rotating it in either clockwise or counterclockwise direction to start firing without the need of depressing any button. In one case, a complete rotation of the electronic rotary trigger can result in firing a single round of ammunition. Alternatively, the electronic rotary trigger can be hand-rotated up to a desired level to fire respective rounds or numbers of ammunition. In one case, the rotation of the electronic rotary trigger can actuate the delinker and motor to start firing. Alternatively, a separate push-button can be provided for the delinker. The number of rounds of ammunition fired can depend on the degree of rotation of the electronic rotary trigger between the discrete pre-programmed intervals. In one case, the rate of firing can be proportional to degree of rotation of the electronic rotatory trigger. To increase the rate of firing the user can further rotate the electronic rotatory trigger, wherein the rotation of the electronic rotatory trigger can result in firing. In one case, the electronic rotatory trigger can stop rotating or freely rotates when the maximum firing rate can be achieved.

In one exemplary embodiment, the rotation of the electronic rotary trigger can be analogous to the hand crank of the Gatling-style platform, rotating clockwise or counterclockwise to a certain degree of angle, to fire off a round or rounds depending upon the programmable sequenced interval. The control system can limit the firing to the discrete number of ammunition or rounds of ammunition based on the selected level from the pre-discrete intervals. Additionally, an option can also be provided to change the rate of firing.

In one exemplary embodiment, the electronic rotary trigger can be configured in a remote device coupled to the control system. A selection can be made on the remote device and the control system can receive a signal from the remote device indicating the selection, and the control system can then, depending on the selection, be actuated firing the predefined sequence of ammunition. In one case, the sequence or the number of rounds can be set remotely, and an electronic rotary trigger or push-button trigger in the Gatling-style platform can be actuated single or multiple times to fire till the set sequence or the number of rounds are exhausted. Thus, the user can not only set the numbers of rounds per trigger actuation but can also limit the number of rounds of ammunitions per multiple trigger actuation.

In one exemplary embodiment, the user can also set a firing rate, i.e., the number of ammunitions fired per full rotation. A rotary dial, or a similar mechanism, can be provided for setting the firing rate. The rotary dial can be made hybrid with the electronic rotary trigger or can be provided as separate. In one case, two rotary dials can be provided nearby the two handles. The desired rate of firing can be set before triggering the gun. Additionally, the rate of firing is dependent on the user's speed of manual rotation of the electronic rotary trigger without a rotary dial. For example, while the electronic rotary trigger is rotated for firing, the rotary dial can be set or changed to increase or decrease the rate of firing. It is to be understood that the rotary dial can be replaced by any other counter known to a skilled person for increasing and decreasing a counter value in electronic devices, and any such mechanism is within the scope of the present invention.

Also, it is to be understood that FIG. 1 shows an M134 Gatling-style platform, however, any Gatling gun or similar platform is within the scope of the present invention, wherein the disclosed control system can control the firing within the pre-programmed discrete levels. Gatling-style platforms generally use a delinker for feeding ammunition while other electronic guns may use magazines as well.

Also, it is to be understood that the clearing of live ammunition after use of the firearm within the present invention can be dependent upon the firearm containing or not containing a clutch to engage the delinker and/or upon the configuration of the control system. In one case, when the electronic rotary trigger is no longer in rotation, the firearm can have a time delay relay that has the clutch disengage the delinker causing the flow of ammunition to come to a halt, but power would still go to the motor that would continue to turn the firing structure firing off the remaining live ammunition within the firing structure of the firearm, or could simply operate the motor without a delinker causing the live ammunition to be expelled out of the firearm leaving it as safe. In one case, when the limited function push-button is released it disengages the feeder/delinker stopping the flow of ammunitions to the firearm, and continued user movement of the electronic rotary trigger, which is in direct connection with the motor, allows for the continuous firing off of the remaining live ammunition within the firing structure of the firearm.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. An electronic firearm comprising:

an electronic motor;

a plurality of barrels configured to be rotated by the electronic motor;

a control system operably coupled to the electronic motor, wherein the control system is configured to limit and control a number of ammunitions or rounds of ammunitions fired within a plurality of predefined discrete levels; and an electronic rotary trigger operably coupled to the control system, wherein the electronic rotary trigger is configured to be rotated, wherein rotation of the electronic rotary trigger triggers firing, wherein a degree of rotation of the electronic rotary trigger is proportional to a rate of firing.

2. The electronic firearm according to claim 1, wherein the electronic rotary trigger has a plurality of predefined discrete levels, wherein the electronic rotary trigger is configured to be rotated to a level of the plurality of predefined discrete levels, wherein the control system is configured to receive a signal from the electronic rotary trigger indicating the level, and the control system is configured to limit the number of ammunitions fired to the level.

3. The electronic firearm according to claim 1, wherein the electronic rotary trigger is configured to be rotated in a clockwise or a counter-clockwise direction.

4. The electronic firearm according to claim 1, wherein the electronic firearm further comprises:

a delinker;

a clutch; and a time delay relay, wherein the delinker is operably coupled to the electronic motor, the clutch configured to couple the electronic rotary trigger to the delinker, wherein, upon rotating the electronic rotary trigger, the clutch is configured to engage the delinker to feed the ammunition, wherein time delay relay is configured to cause firing to continue till a remaining live ammunition is exhausted when a flow of ammunition is halted.

5. The electronic firearm according to claim 1, wherein the electronic firearm further comprises:

a remote device wirelessly coupled to the control system, the remote device configured to receive a selection of a level from the plurality of predefined discrete levels, wherein the control system is configured to receive a signal from the remote device indicating the selected level, and the control system is configured to limit the number of ammunitions fired to the selected level, wherein the remote device comprises a second electronic rotary trigger wirelessly coupled to the control system, wherein rotation of the second electronic rotary trigger results in the firing of ammunition.

6. The electronic firearm according to claim 1, wherein the electronic firearm further comprises:

a second electronic rotary trigger;

a first handle and a second handle, wherein the electronic rotary trigger and the second electronic rotary trigger are positioned in proximity to the first handle and the second handle respectively.

7. The electronic firearm according to claim 1, wherein a complete rotation of the electronic rotary trigger results in firing a single round of ammunition.

8. The electronic firearm according to claim 1, wherein the electronic rotary trigger is configured to be rotated to a first degree for a first firing rate and further rotated to a second degree for a second firing rate after a desired duration.

9. A method for controlling a number of ammunitions fired by a Gatling-style platform, the method comprising the steps of:

providing a Gatling-style platform comprising:

an electronic motor;

a plurality of barrels configured to be rotated by the electronic motor;

a control system operably coupled to the electronic motor, wherein the control system is configured to limit and control a number of ammunitions or rounds of ammunitions fired within a plurality of predefined discrete levels; and an electronic rotary trigger operably coupled to the control system, wherein the electronic rotary trigger is configured to be rotated, wherein rotation of the electronic rotary trigger triggers firing, wherein a degree of rotation of the electronic rotary trigger is proportional to a rate of firing;

rotating the electronic rotary trigger to a first degree of rotation to trigger firing at a first rate of firing;

upon firing, further rotating the electronic rotary trigger to a second degree of rotation to fire at a second rate of firing.

10. The method according to claim 9, wherein wherein the electronic rotary trigger is configured to be rotated to a level of the plurality of predefined discrete levels, wherein the control system is configured to receive a signal from the electronic rotary trigger indicating the level, and the control system is configured to limit the number of ammunitions fired to the level.

11. The method according to claim 9, wherein the electronic rotary trigger is configured to be rotated in a clockwise or a counter-clockwise direction.

* * * * *